US011214930B2

(12) United States Patent
Vossman

(10) Patent No.: US 11,214,930 B2
(45) Date of Patent: Jan. 4, 2022

(54) SYSTEM AND METHOD FOR MODIFYING AND REPAVING PAVED SURFACES

(71) Applicant: McAnany Construction, Inc., Shawnee, KS (US)

(72) Inventor: Eric D. Vossman, Lake Quivira, KS (US)

(73) Assignee: McAnany Construction, Inc., Shawnee, KS (US)

( * ) Notice: Subject to any disclaimer, the term of this patent is extended or adjusted under 35 U.S.C. 154(b) by 425 days.

(21) Appl. No.: 16/279,774

(22) Filed: Feb. 19, 2019

(65) Prior Publication Data

US 2019/0257039 A1 Aug. 22, 2019

Related U.S. Application Data

(60) Provisional application No. 62/632,205, filed on Feb. 19, 2018.

(51) Int. Cl.

| | |
|---|---|
| ***E01C 11/00*** | (2006.01) |
| ***E01C 7/35*** | (2006.01) |
| ***E01C 19/48*** | (2006.01) |
| ***E01C 19/21*** | (2006.01) |
| ***E01C 23/08*** | (2006.01) |
| ***E01C 23/088*** | (2006.01) |

(52) U.S. Cl.

CPC ..... *E01C 11/005* (2013.01); *E01C 7/356* (2013.01); *E01C 19/21* (2013.01); *E01C 19/4873* (2013.01); *E01C 23/088* (2013.01)

(58) Field of Classification Search

CPC ..... E01C 11/005; E01C 7/356; E01C 19/21; E01C 19/4873; E01C 23/088

See application file for complete search history.

(56) References Cited

U.S. PATENT DOCUMENTS

| | | | | |
|---|---|---|---|---|
| 4,124,325 | A * | 11/1978 | Cutler | E01C 19/187 404/118 |
| 5,069,578 | A * | 12/1991 | Bense | E01C 19/4853 404/75 |
| 5,819,870 | A | 10/1998 | Braun | |
| 6,079,901 | A * | 6/2000 | Banks | E01C 19/48 239/128 |
| 6,776,557 | B2 * | 8/2004 | Barnat | E01C 19/21 404/101 |
| 6,805,516 | B2 | 10/2004 | At et al. | |
| 6,830,408 | B1 | 12/2004 | Blankenship et al. | |
| 7,438,764 | B1 * | 10/2008 | Hill | E01C 19/176 118/313 |
| 7,632,038 | B2 | 12/2009 | Buschmann et al. | |
| 7,802,941 | B2 | 9/2010 | Wingo et al. | |

(Continued)

*Primary Examiner* — Abigail A Risic

(74) *Attorney, Agent, or Firm* — Law Office of Mark Brown, LLC; Mark E. Brown

(57) ABSTRACT

An ultrathin bonded asphalt surface (UBAS) system and method for resurfacing paved asphalt surfaces, particularly local, collector and residential streets in residential neighborhoods, including cul-de-sacs and roundabouts. The asphalt surface can be prepared with a milling machine. A spray paver applies emulsion bonding liquid (EBL) to the prepared asphalt surface at a predetermined shot rate. Aggregate material is discharged from the spray paver onto the EBL. The system is utilized in performing a UBAS resurfacing method according to the present invention.

7 Claims, 3 Drawing Sheets

(56) References Cited

U.S. PATENT DOCUMENTS

| | | | | |
|---|---|---|---|---|
| 8,025,459 | B2 * | 9/2011 | Buschmann | E01C 19/48 404/111 |
| 8,356,958 | B2 | 1/2013 | Braun et al. | |
| 8,628,271 | B2 | 1/2014 | Braun | |
| 9,168,961 | B2 | 10/2015 | Braun | |
| 9,334,896 | B2 | 5/2016 | Braun | |
| 10,683,621 | B2 * | 6/2020 | Stahl | E01C 23/088 |
| 10,982,097 | B2 * | 4/2021 | LaRusso | E01C 19/21 |
| 2008/0124173 | A1 * | 5/2008 | Buschmann | E01C 19/176 404/111 |
| 2009/0285631 | A1 | 11/2009 | Buschmann et al. | |
| 2010/0296868 | A1 | 11/2010 | Braun | |
| 2014/0346841 | A1 * | 11/2014 | Wachsmann | B28D 1/188 299/77 |
| 2016/0289902 | A1 * | 10/2016 | Eul | G07C 5/0841 |
| 2017/0037585 | A1 * | 2/2017 | Buschmann | E01C 19/42 |
| 2019/0062558 | A1 * | 2/2019 | LaRusso | C08L 95/005 |

* cited by examiner

SYSTEM AND METHOD FOR MODIFYING AND REPAVING PAVED SURFACES

CROSS-REFERENCE TO RELATED APPLICATION

This application claims priority in U.S. Provisional Patent Application No. 62/632,205, filed Feb. 19, 2018, which is incorporated herein by reference.

BACKGROUND OF THE INVENTION

1. Field of the Invention

The present invention relates generally to a system and method for modifying and resurfacing pavement, and more specifically to repaving with hot mix asphalt (HMA) material, including, without limitation, ultrathin bonded asphalt surfaces (UBAS) in local, neighborhood and residential-categorized streets, including cul-de-sacs and roundabouts.

2. Description of the Related Art

UBAS is traditionally applied on highways and major thoroughfares. Without limitation on the generality of useful applications, the UBAS system and method of the present invention are applicable to restricted residential streets by using equipment without a shuttle buggy or a similar material transfer vehicle. The invention enables one-pass spray paver operations to be completed relatively quickly with less disruption of local traffic, thus minimizing inconvenience to motorists and potential damage to vehicles and other property.

The methods described herein allow the UBAS process to be completed relatively quickly in residential areas, on local streets and in other areas. Significant efficiency improvements and cost savings can be achieved with the present invention. For example, aggregate material quantity requirements are only about 25% of such requirements for comparable projects utilizing conventional repaving procedures. Moreover, the greater material efficiencies achieved with the present invention enable completing projects with fewer vehicles, e.g. material hauling trucks, sweepers, laydown machines, etc. Disruption of local traffic can thus be minimized.

Negative environmental impacts can also be minimized, as compared to conventional resurfacing procedures. Such conventional procedures commonly involve approximately 2-inch-thick overlays and produce substantial quantities of materials requiring disposal (e.g., in landfills). HMA materials are more efficiently utilized with the present invention for greater efficiencies and less negative environmental impact.

Faster project turnarounds and completions using the system and method of the present invention benefit the project owners and repaving services customers. Heretofore there has not been available a system and method with the advantages and features of the present invention.

DETAILED DESCRIPTION OF THE PREFERRED EMBODIMENTS

I. Introduction and Environment

Figure 1:
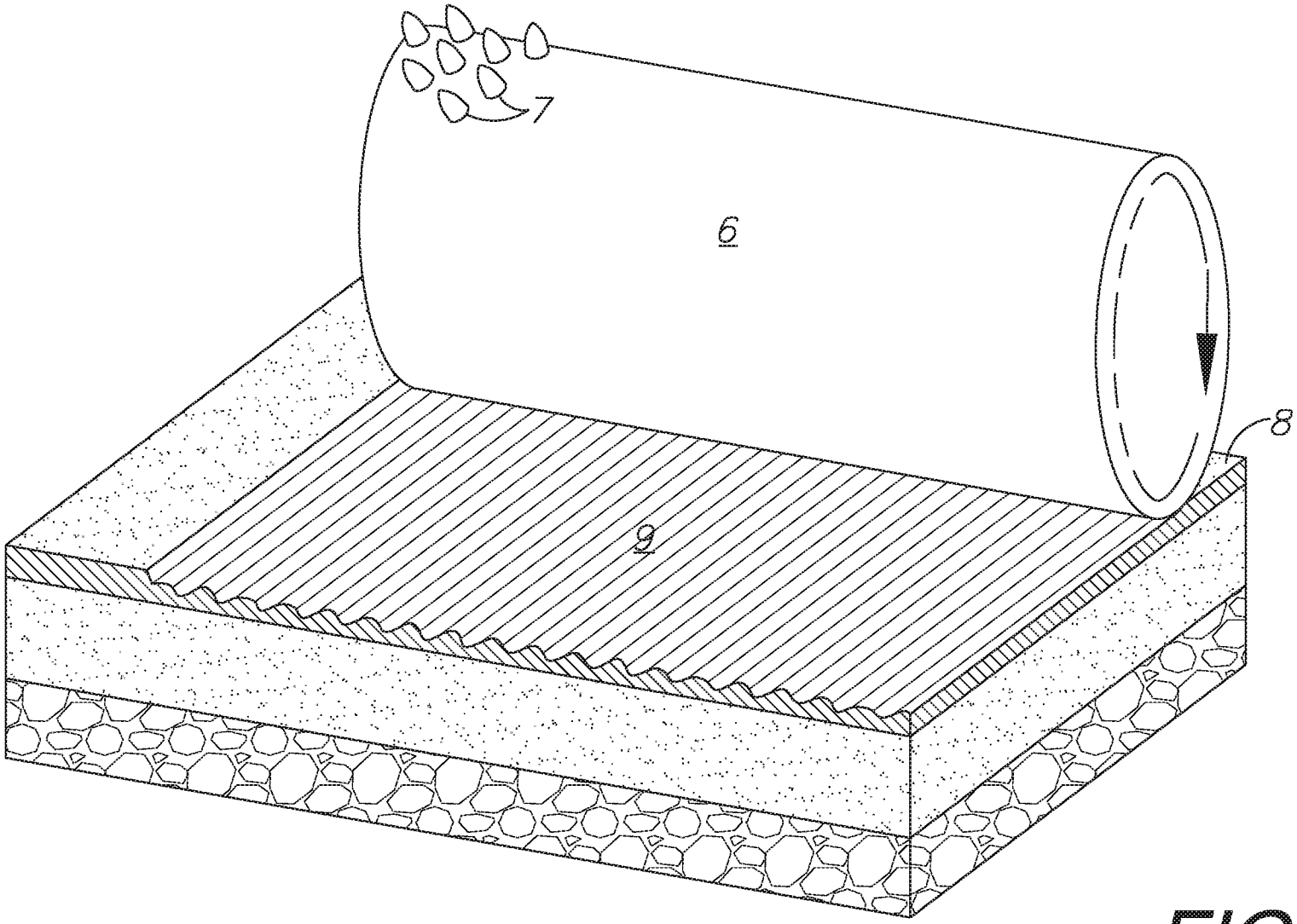
FIG. 1 is an enlarged, perspective view of a milling machine drum, shown milling a section of asphalt pavement, which is an initial surface preparation step in practicing the method of the present invention.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. UBAS System 2 and Method

Without limitation, the system and method of the present invention utilizes: a milling machine equipped with a milling drum 6 and configured for milling an existing asphalt surface 8; and a spray paver 10 configured for spraying a layer of emulsion bonding liquid (EBL) 12 and screeding a layer of asphalt aggregate material 14 thereon. A compacting roller vehicle then compacts the aggregate material 14 into the EBL 12 as a final step in the process of the present invention. The resurfaced asphalt pavement structure can then be driven on.

III. Milling Machine

Without limitation, the milling machine can comprise a Wirtgen cold milling machine produced by Wirtgen GmbH. The milling drum 6 can comprise a fine milling drum with pointed chisels or tools 7 spaced at approximately 8 mm transversely and configured for removing approximately 16 mm (⅝") of pre-existing asphalt pavement 8. Such operating parameters can be scaled within the scope of the present invention. The aggregate material 14 can be transported off-site for use on other projects, combining with other aggregate materials, etc. Substantial cost savings can be achieved with minimal environmental impact by recycling the asphalt aggregate material milled and collected by the milling machine.

Figure 2:
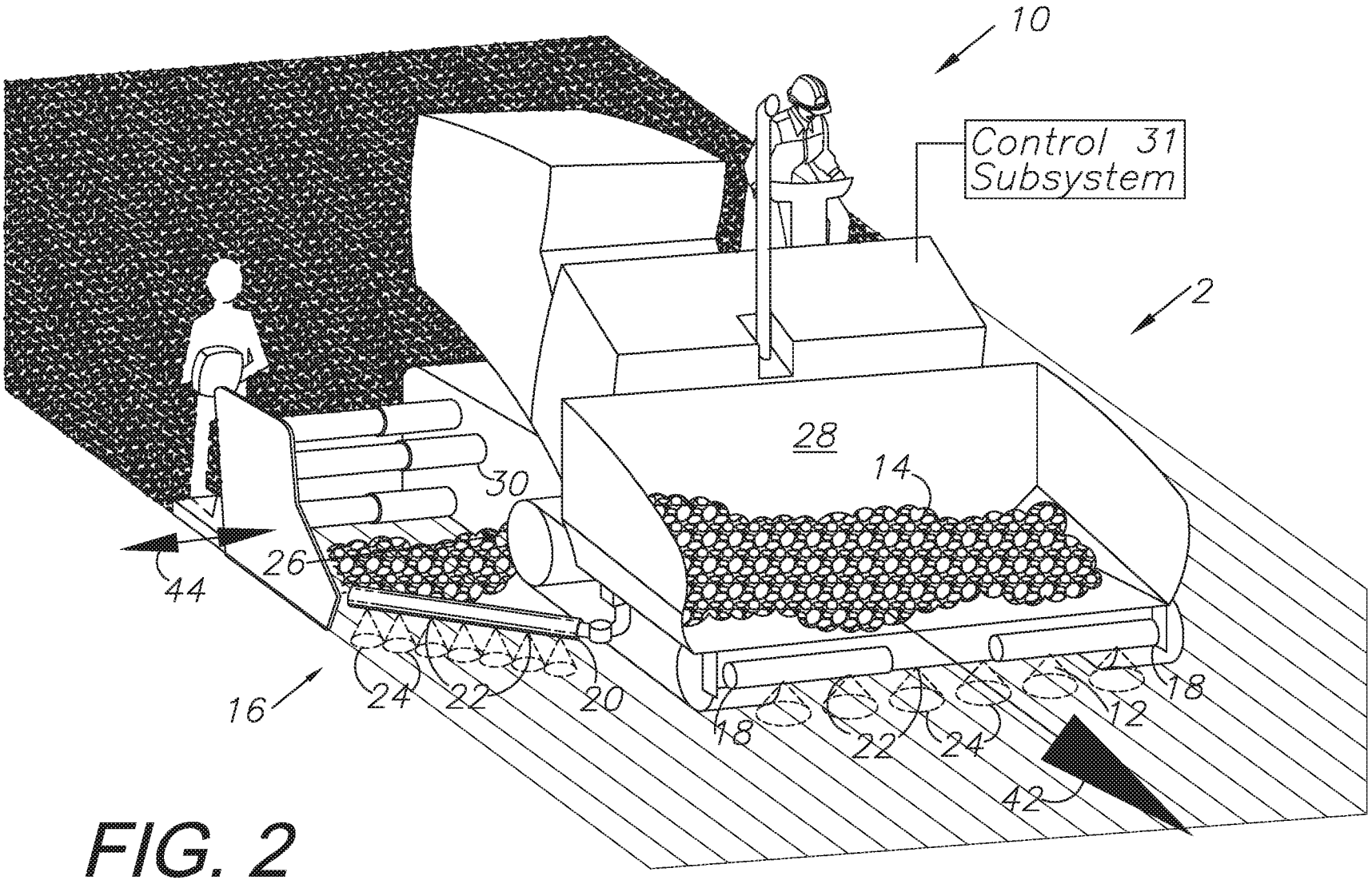
FIG. 2 is a perspective view of an example of a spray paver, which can be utilized in an asphalt resurfacing procedure embodying an aspect of the present invention.

IV. Spray Paver 10 (FIG. 2)

Without limitation, the spray paver (or lay-down machine) 10 can comprise a Vogele model Super 1800-3i SprayJet machine, which is also available from Wirtgen GmbH. The spray paver 10 includes an EBL discharge subsystem 16 with front-mounted, horizontal, transversely-extending EBL spray bars (or conduits) 18. A pair of side-mounted, horizontal, EBL spray bars 20 extend laterally from the sides of the spray paver 10. The spray bars 20 are pivotally attached to the spray paver 10 for adjusting their angular orientations relative to the direction of travel of the spray paver 10, generally designated by direction-of-travel arrow. The overall width of the EBL spray pattern can thus be adjusted independently with respect to each side. Each spray bar 18, 20 includes multiple spray nozzles 22 which define downwardly-extending EBL spray patterns 24. The spray paver 10 preferably applies a relatively uniform coat of EBL to the milled pavement 8.

The spray paver 10 preferably applies a relatively thin, uniform layer of aggregate material 14 over the EBL coating via an aggregate discharge subsystem 26, including a front hopper 28. The aggregate material 14 is conveyed rearwardly from the hopper 28 by a pair of longitudinally-extending belt conveyors to a pair of transversely-extending screw augers, which discharge the aggregate material 14 latterly from one or both sides of the spray paver 10. Adjustable screed subassemblies 30 are reciprocably extendable and retractable relative to the spray paver sides as shown by the extension-retraction directional arrows 44 (FIG. 2). The spray paver 10 also includes a rear-mounted screed subassembly. Collectively, the screed subassemblies function to uniformly smooth the aggregate material on the EBL material, thus forming the UBAS layer.

The spray paver 10 includes a control subsystem 31, which can include manual controls for adjusting the spray paver 10 to accommodate the residential streets and other paved surfaces being resurfaced. Automated controls can also be utilized for guiding the spray paver 10 and adjusting its operating parameters. For example and without limitation, a microprocessor can be programmed to automate various spray paver 10 operations.

The control subsystem 31 can also include a Global Navigation Satellite System (GNSS) positioning and guidance subsystem. For example and without limitation, the U.S.-based Global Positioning System (GPS) can be utilized for relatively precise equipment guidance and control. Such automation can contribute to further efficiencies and cost savings by reducing material consumption, saving time and minimizing property damage. Suitable automation components are used in a variety of applications with different types of equipment, and can be adapted to the present invention.

The EBL discharge subsystem 16 can be configured with individually and selectively operable spray nozzles 22. The control subsystem 31 can be programmed to individually and variably open and close the spray nozzles 22 based on their respective locations. For example, the control subsystem 31 can minimize overspray and corresponding EBL material waste. Individually and variably controlling spray output quantities of the nozzles 22 can enable uniform material quantity applications, including around curves, such as Pass 1, designated 34 in FIG. 3. The outer nozzles 22 would discharge EBL in the largest quantities, as compared to the inside nozzles 22 following the shorter, inner radius of the curving spray path. Still further, the controller 31 and the individually operable spray nozzles 22 can skip predesignated areas.

V. Operation

Figure 3:
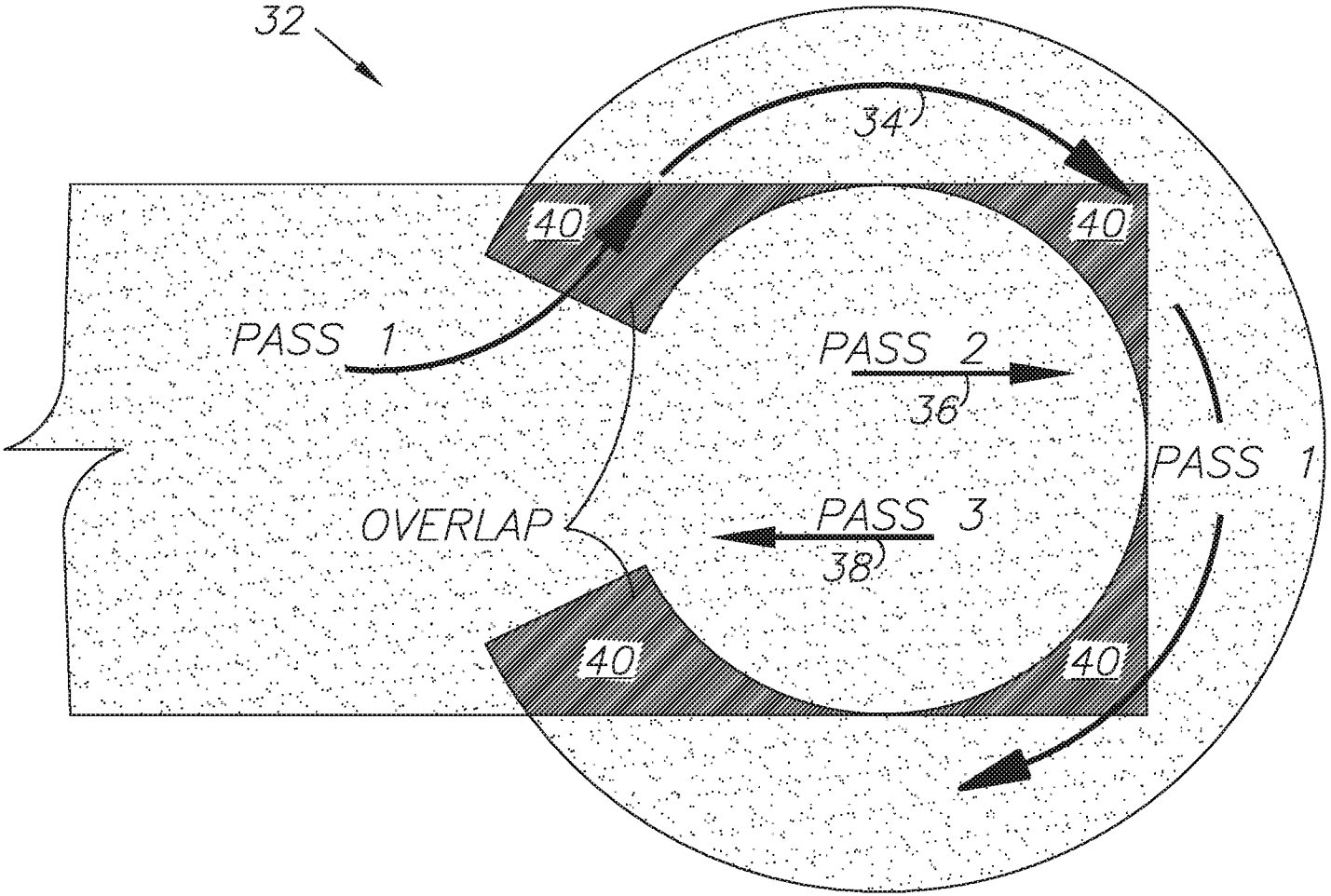
FIG. 3 is a plan view of a cul-de-sac, showing an example of a pass sequence for a spray paver practicing the method of the present invention.

FIG. 3 shows a sequence of passes with the spray paver 10 on a cul-de-sac 32, with a configuration typically found in many residential subdivisions. Without limitation, a first pass 34 can encircle the paved surface 8. Second and third passes 36, 38 substantially finish covering the paved surface 8 within the cul-de-sac 32. The spray paver 10 can be programmed to avoid overlapping areas 40 for maximizing efficient material application. Moreover, the side EBL spray bars or conduits 20 can be selectively pivoted to appropriate positions for desired EBL coverage. Still further, the screed subassemblies 30 can be selectively extended and retracted as appropriate to align the repaving UBAS layer with the side margins of the paved surface 8.

The milling machine drum 6 can be configured for removing the top layer of the existing surface 8 while traveling at approximately 80-120 feet per minute (FPM), which can produce a preferred, prepared surface 9 with a suitable, milled macrotexture at these speeds and under typical conditions. Typical drum spacing of about 15 mm would result in the milling process being conducted at speeds of approximately 40-50 FPM to reach the desirable macrotextured surface. The use of a "micro drum" 6 with transverse teeth spacing of about 8 mm allows the milling process to be conducted at approximately 80-120 FPM, resulting in a more efficient process. This expedited process creates less disturbance to the area residents as well as cost savings for the project owners and customers. Preferably street profiles should remain relatively consistent, with only small changes resulting from procedures performed with the system and method of the present invention.

The street is cleaned with a street sweeper broom with an hydraulic pickup for transporting the swept debris. The broom can have left and right gutter brooms and the system can spray water to minimize dust.

Table 1 below shows an example of a UBAS design for a typical residential repaving project performed with the present invention. Using the system and method of the present invention, relatively low quantities of binding material (EBL) are required for bonding with the aggregate. For example, the HMA can comprise approximately 95% aggregate and only about 5% EBL. Other HMA design ratios can be utilized within the scope of the present invention.

TABLE 1

Example: HMA Design Ratios for UBAS Repaving Project

| Binding Material Layer (EBL) Shot Rate | Aggregate | Liquid Asphalt (oil) |
|---|---|---|
| .2 gal/SY | 95% | 5% |

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. An ultrathin bonded asphalt surface (UBAS) asphalt surface repaving system comprising:

a milling machine with a rotating drum configured for milling a layer of existing asphalt material and texturizing said asphalt surface in preparation for application of emulsion bonding liquid (EBL) and hot mix asphalt (HMA) in one pass;

a spray paver machine including: front and back ends; opposite sides; a hopper configured for receiving asphalt surface aggregate; an emulsion bonding liquid (EBL) reservoir; an EBL discharge subsystem connected to said EBL reservoir; an aggregate discharge subsystem; and a screed subassembly;

said EBL discharge subsystem including: a front, leading EBL spray bar at said spray paver machine front end; a pair of side EBL spray bars each pivotally attached to a respective spray paver machine side and configured for pivotally swinging fore-and-aft relative to said spray paver machine;

multiple, selectively variable-output spray nozzles mounted in spaced relation along said leading and side EBL spray bars;

said aggregate discharge subsystem including first and second screw augers extending transversely relative to said spray paver machine and configured for discharging aggregate laterally from the sides of said spray paver machine;

a controller programmed for applying predetermined quantities-per-area of EBL to said prepared asphalt surface and predetermined quantities-per-area of aggregate to said EBL;

said controller is connected to said spray nozzles and is configured for pre-programming with an EBL application pattern which avoids overspray and gaps in said EBL selectively and variably controlling their respective EBL discharges;

said controller is configured for controlling the application of said EBL over said pattern;

a Global Positioning System (GPS) positioning device connected to said controller; and said controller configured for selectively, individually and variably controlling the output of said spray nozzles based on said spray paver machine location determined by said GPS positioning device.

2. The UBAS repaving system according to claim 1 wherein said asphalt surface is located within a residential neighborhood.

3. The UBAS repaving system according to claim 1 wherein said asphalt surface is located in one of a cul-de-sac and a roundabout.

4. The UBAS repaving system according to claim 1 wherein said rotating drum includes multiple chisels with a transverse spacing in the range of approximately 7-9 mm.

5. The UBAS repaving system according to claim 1 wherein said EBL is applied with a shot rate in the range of approximately 0.1-0.2 GAL/SY.

6. The UBAS repaving system according to claim 1 wherein said aggregate-liquid asphalt ratio is in the range of approximately 18.5:1.5 to 19.5:0.5.

7. A method of repaving an asphalt surface with an ultrathin bonded asphalt surface (UBAS) comprising the steps of:

providing a milling machine with a rotating drum configured for milling a layer of existing asphalt material and texturizing said asphalt surface in preparation for application of emulsion bonding liquid (EBL) and hot mix asphalt (HMA) in one pass;

providing a spray paver machine including: front and back ends; opposite sides; a hopper configured for receiving asphalt surface aggregate; an emulsion bonding liquid (EBL) reservoir; an EBL discharge subsystem connected to said EBL reservoir; an aggregate discharge subsystem; and a screed subassembly;

providing said EBL discharge subsystem with: a front, leading EBL spray bar at said spray paver machine front end; a pair of side EBL spray bars each pivotally attached to a respective spray paver machine side and configured for pivotally swinging fore-and-aft relative to said spray paver machine;

providing multiple, selectively variable-output spray nozzles mounted in spaced relation along said leading and side EBL spray bars;

said aggregate discharge subsystem including first and second screw augers extending transversely relative to said spray paver machine and configured for discharging aggregate laterally from the sides of said spray paver machine;

providing a controller programmed for applying predetermined quantities-per-area of EBL to said prepared asphalt surface and predetermined quantities-per-area of aggregate to said EBL;

said controller is connected to said spray nozzles and is configured for pre-programming with an EBL application pattern which avoids overspray and gaps in said EBL selectively and variably controlling their respective EBL discharges;

said controller is configured for controlling the application of said EBL over said pattern;

providing a Global Positioning System (GPS) positioning device connected to said controller; and said controller configured for selectively, individually and variably controlling the output of said spray nozzles based on said spray paver machine location determined by said GPS positioning device.

* * * * *